US006122787A

United States Patent [19]

Kao

[11] Patent Number: 6,122,787

[45] Date of Patent: Sep. 26, 2000

[54] SECTIONED ERGONOMIC BED MATTRESS

[76] Inventor: Pei-Chin Kao, 2Fl.-1, No. 399, Ching-Kuo Rd., Taoyuan City, Taiwan

[21] Appl. No.: 09/453,182

[22] Filed: Dec. 2, 1999

[51] Int. Cl.[7] ..... A47C 27/05; A47C 27/04

[52] U.S. Cl. ..... 5/723; 5/720; 5/727

[58] Field of Search ..... 5/723, 722, 716, 5/720, 721, 727, 737, 738, 655.8

[56] References Cited

U.S. PATENT DOCUMENTS 1,784,294 12/1930 Kriege ..... 5/723
2,216,991 10/1940 Trovillo ..... 5/723
3,251,078 5/1966 Calla ..... 5/655.8
3,626,523 12/1971 Robins ..... 5/727

*Primary Examiner*—Alexander Grosz
*Attorney, Agent, or Firm*—Jones Tullar & Cooper, PC

[57] ABSTRACT

A sectioned ergonomic bed mattress is disclosed. The mattress includes at least two sub-mattresses each with a top and a bottom cover. Each cover may have a color or pattern unlike any other of the covers such that a user can vary the appearance of the bed mattress by assembling the sub-mattresses in a number of permutations. A plurality of clamps is used to combine the sub-mattresses, and at least one clamp extends between two adjacent sub-mattresses.

4 Claims, 6 Drawing Sheets

SECTIONED ERGONOMIC BED MATTRESS

BACKGROUND OF THE INVENTION

1. Field of the Invention

It is widely understood that a comfortable and refreshing sleep can significantly affect a person's health and mood, yet in fact most mattresses for beds are quite unsuitable for giving the maximum comfort and rest. This is because mattresses do not take into account the different load points thereon caused by the sleeping body. Additionally, a cover retaining a buffer pad and springs in the mattress is not replaceable, which is inconvenient if it gets damaged or dirty. Further significant drawbacks to the conventional bed mattress are that it has a fixed size which is much too big to be transported or stored conveniently, and the cover has a single fixed color and/or pattern.

2. Description of Related Art

A conventional bed mattress (90), as shown in FIG. 6, comprises a plurality of compression springs (91) enclosed within a frame, and two buffer pads (92) respectively disposed on a top face and a bottom face of the frame. A cover (93) is stretched over the frame to retain the springs (91) and the buffer pads (92) in position. The cover (93) is a single sheet and cannot be varied. The compression springs (91) are all of one same length, and the buffer pad (92) is thin and of a fixed thickness. It is found that that such a mattress does not take into account different load points of a body resting thereon, that is, projecting parts of a body support a disproportionate portion of its weight, resulting in discomfort and poor sleep. Furthermore, the mattress quickly is deformed due to not being designed to resist unevenly dispersed pressure. Additionally, the mattress (90) is of a fixed size which makes it very difficult to transport or store.

SUMMARY OF THF INVENTION

A sectioned ergonomic mattress with removable and differently colored and/or patterned covers is disclosed. The mattress is divided into a plurality of sub-mattresses which each contain a frame. A plurality of compression springs is housed within each sub-mattress. Two buffer pads are respectively disposed on a top face and a bottom face of each sub-mattress, and respectively abut top and bottom tips of the compression springs. Each cover comprising a top portion and a bottom portion surrounds each sub-mattress, the buffer pads, and the springs, is removably secured to a peripheral side edge of the respective sub-mattress. Each plurality of the springs is divided into several groups each with a length different to the respective lengths of the other groups. The springs of each group have a same fixed length. The buffer pads have varying thickness corresponding to pressure points of a sleeper. The groups of springs are respectively disposed within the frames, in accordance with the load points of the sleeper. The ergonomic mattress accordingly provides a comfort and appropriate support for the sleeper, as well as having the covers which can be easily removed and repaired. The sub-mattresses can be combined in various permutations of color or pattern of the cover, in accordance with a user's moods to provide the ergonomic mattress, and separated for easy storage and transportation. The sub-mattresses are securely combined by a plurality of clamps which are easily removed to separate the sub-mattresses for transportation and storage, yet provide a rigid frame when the mattress is assembled.

DETAILED DESCRIPTION OF THE PREFERRED EMBODIMENT

Figure 1:
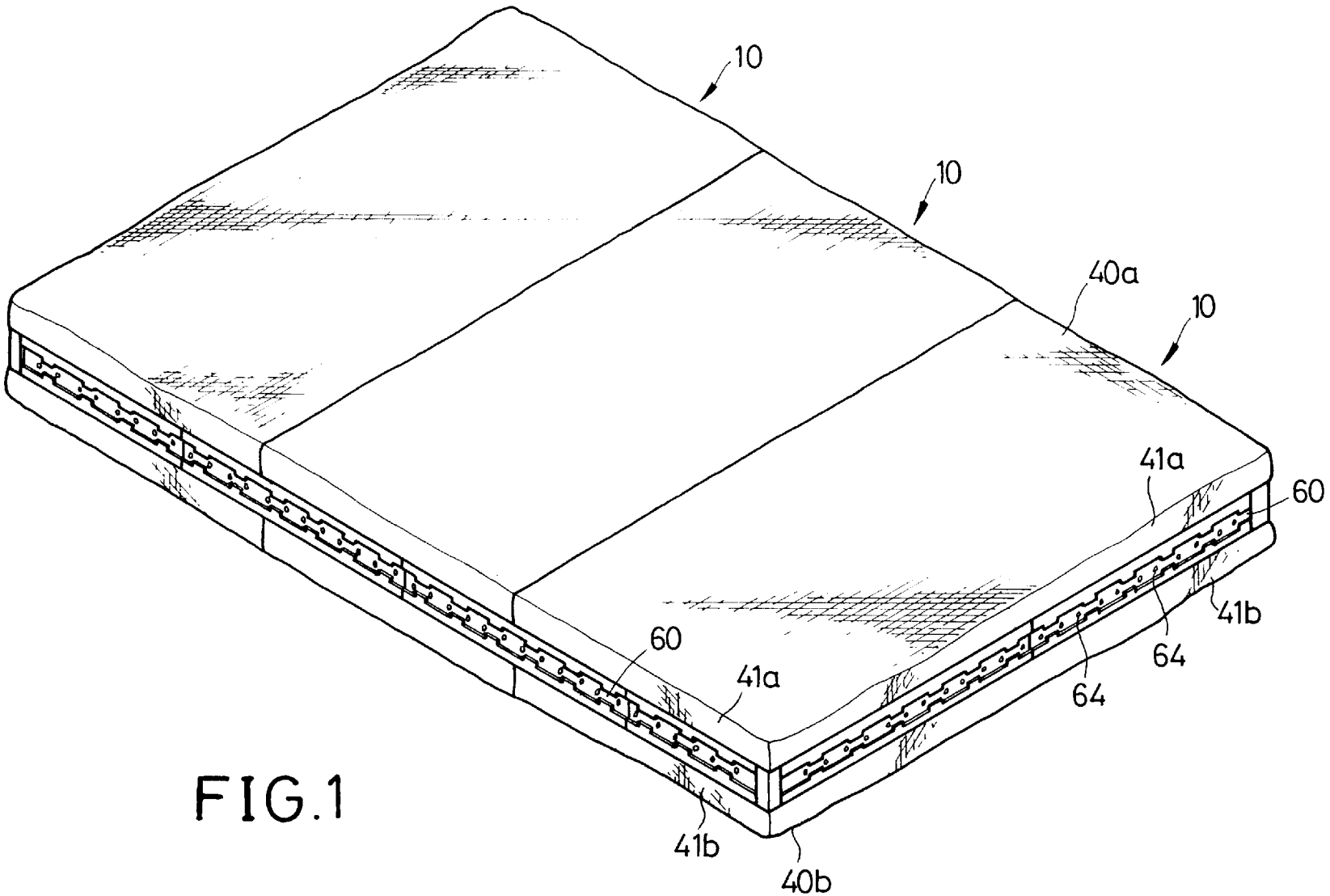
FIG. 1 is a top perspective view of a sectioned ergonomic mattress in accordance with the present invention.
Figure 2:
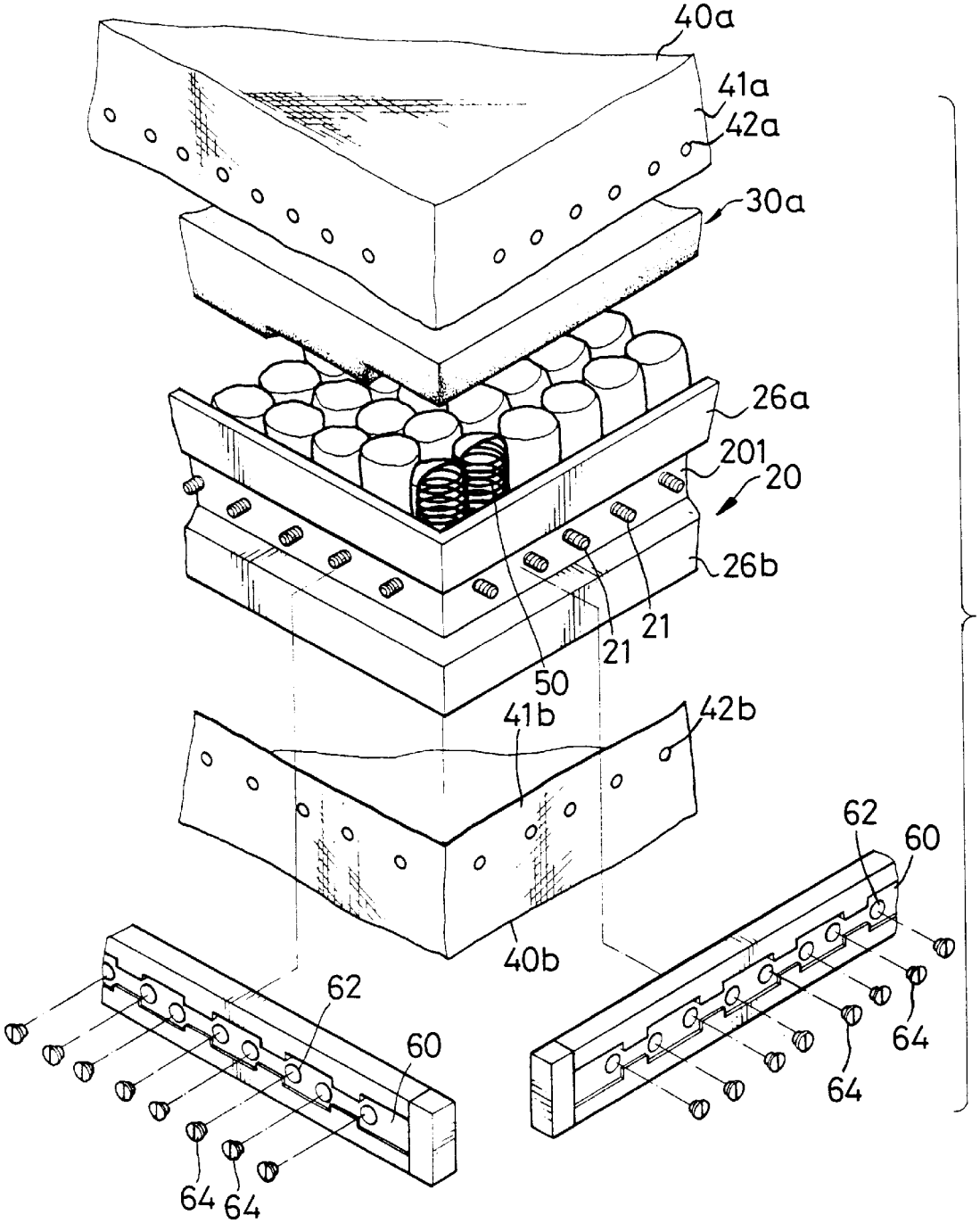
FIG. 2 is an exploded perspective partial view of the sectioned ergonomic mattress of FIG. 1.

Referring to FIGS. 1 and 2, a sectioned ergonomic mattress is disclosed and is divided into a plurality of sub-mattresses (10). The sub-mattresses (10) are identical and each comprise a frame (20), a top and a bottom buffer pad **(30*a*, 30*b*), a top and a bottom cover (40*a*, 40*b*), a plurality of springs (50), a plurality of clamps (60), and a plurality of studs (21). As the sub-mattresses (10)** are identical reference hereinafter is made in the singular.

The frame (20) is rectangular in this embodiment but can be of any shape commonly found in bed design. A recess (201) extends contiguously around an outer face of the frame (20), and the plurality of studs (21) is embedded in a back side defining the recess (201), at regular intervals. The frame (20) further includes a top flange **(26*a*) and a bottom flange (26*b*)** each contiguously extending therearound.

The plurality of springs (50) is divided into several groups of different lengths. The groups of springs (50) are disposed in the frame (20) in accordance with the contours of a human body, as shown in FIG. 2, thereby forming a stepped upper surface and a stepped lower surface. Each spring (50) is contained within a packet whereby sharp tips at either end thereof are covered to prevent damage to the buffer pads **(30*a*, 30*b*)**.

The top buffer pad **(30*a*) has an inner face configured to mate with the stepped upper surface of the groups of springs (50) and a flat outer face. The bottom buffer pad (30*b*) has an inner face configured to mate with the stepped lower surface of the groups of springs (50) and a flat outer face. Respective peripheral edges of the top and bottom buffer pads (30*a*, 30*b*) abut the top and bottom flanges (26*a*, 26*b*), thereby retaining the top and bottom buffer pads (30*a*, 30*b*) in position on the frame (20). Two foam sheets are respectively disposed on the flat outer faces of the buffer pads (30*a*, 30*b*)**

Figure 3:
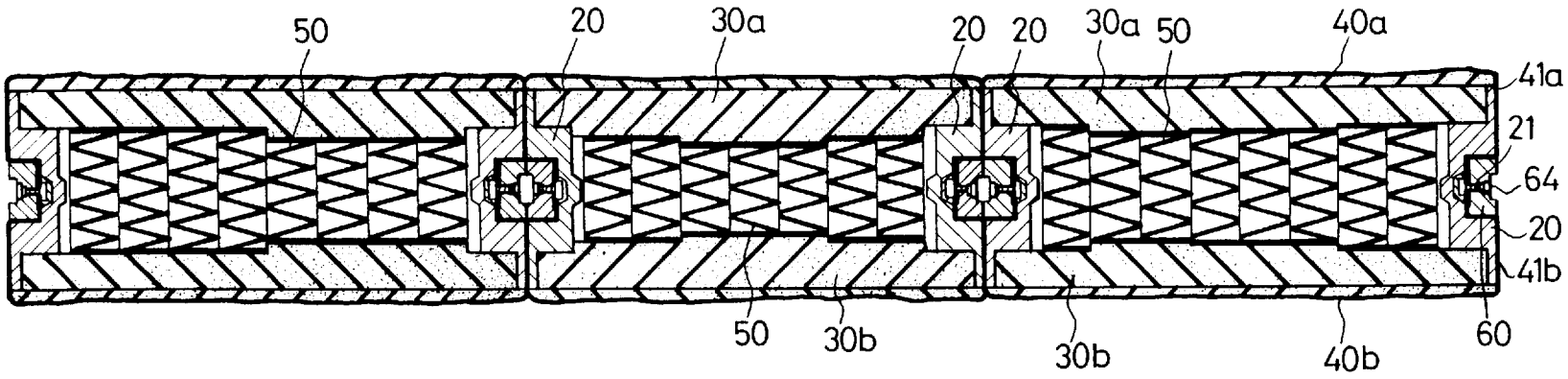
FIG. 3 is a cross -sectional side view of the sectioned ergonomic mattress of FIG. 1.

Still referring to FIGS. 1 and 2, and further to FIG. 3, the top and bottom covers **(40*a*, 40*b*) are respectively fitted over the foam sheets and the buffer pads (30*a*, 30*b*), and peripheral edges (41*a*, 41*b*) thereof are secured to the frame (20) by extending the studs (21) through respective holes (42*a*, 42*b*)** defined therein.

Figure 4:
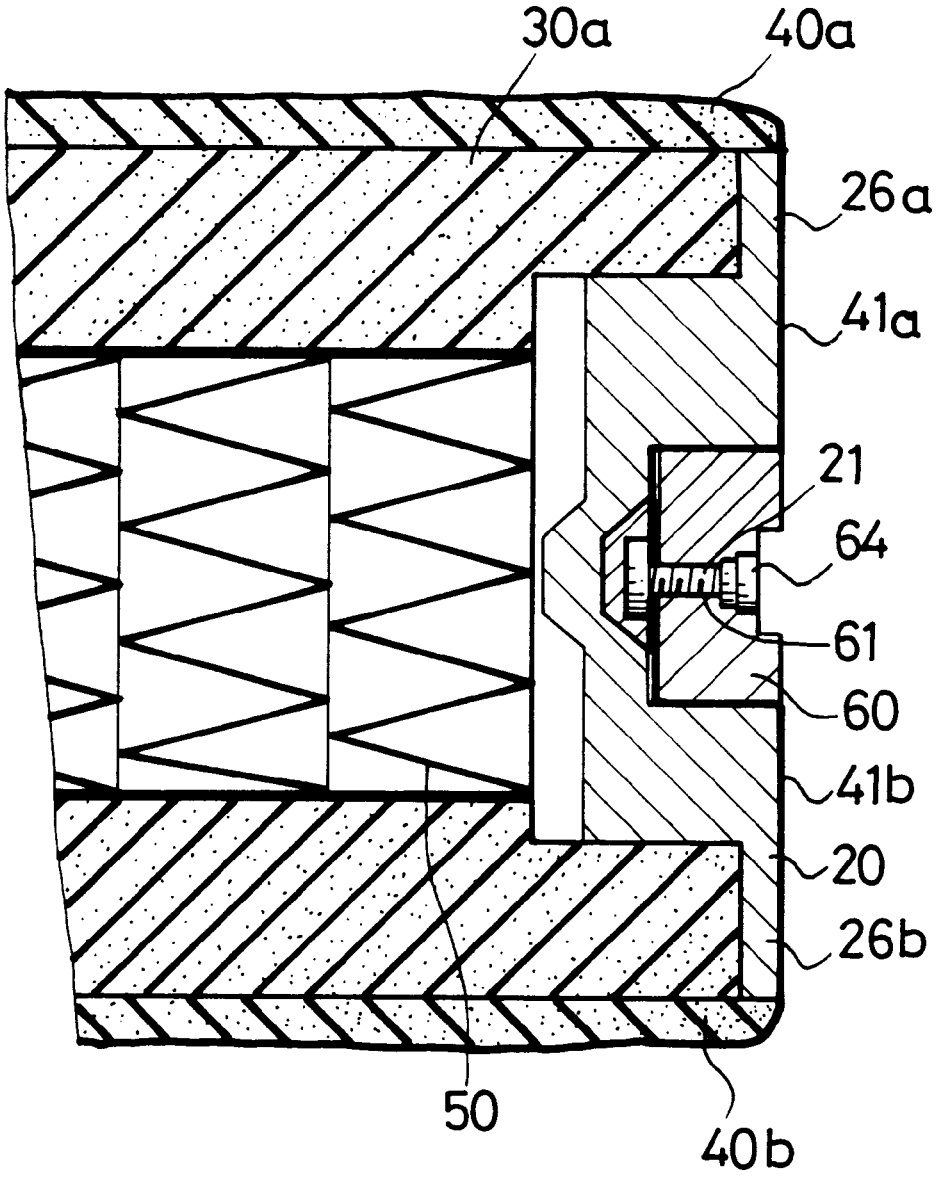
FIG. 4 is an enlarged cross-sectional view of part of the sectioned ergonomic mattress of FIG. 1.
Figure 5:
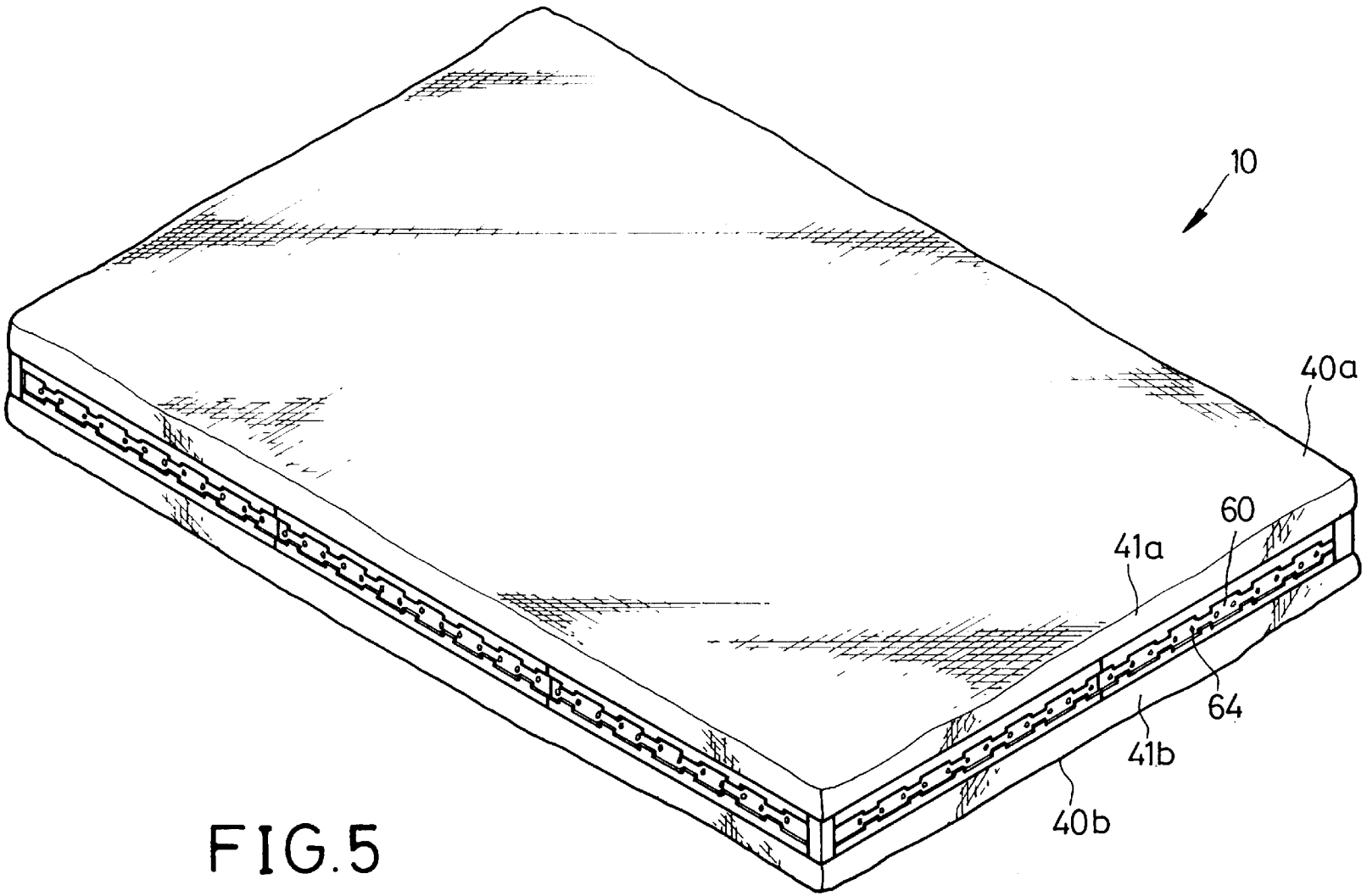
FIG. 5 is a top perspective view of sub-mattress of the invention.
Figure 6:
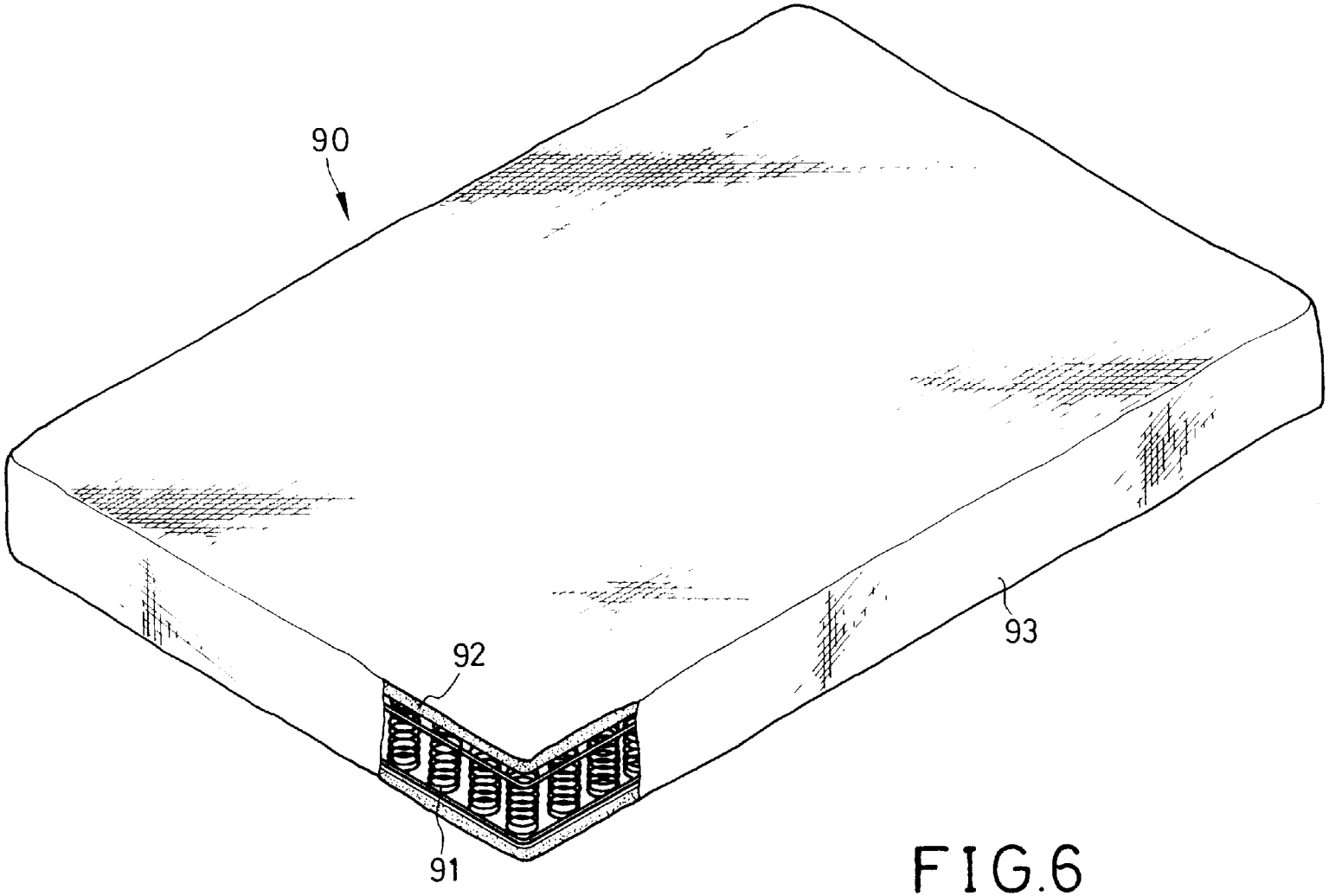
FIG.6 PRIOR ART
FIG. 6 is a view of a prior art mattress

Referring to FIGS. 3 and 4, the clamps (60) are dimensioned to be received in the recess (201), and each define a series of holes (62), each hole (62) being dimensioned to receive a respective one of the studs (21) therethrough. The peripheral edges **(41*a*, 41*b*) o f the top and bottom covers (40*a*, 40*b*) are retained between the back side defining the recess (201) and the clamps (60). A threaded portion of each stud (21) protrudes from the corresponding fitted clamp (60) and threadingly engages with a respective one of a plurality of screw caps (64), whereby each clamp (60) and the top and bottom covers (40*a*, 40*b*) are secured to the frame (20). The clamps (60) are fitted to the sub-mattresses (10) to extend over a respective joint between adjacent sub-mattresses (10)**, whereby a rigid framework is achieved.

In use, the mattress is turned over occasionally so that the top and bottom buffer pads (30*a*, 30*b*) are subjected to equal amounts of wear. The provision of the sub-mattresses (10) permits the mattress to be dismantled for easy storage, transportation and to have a variation in colors and patterns.

The sectioned ergonomic bed mattress of the present invention has the following advantages:

1. contours of the mattress provide a very comfortable bed, and the different length springs (50) provide varying levels of support appropriate for different parts of the human anatomy; and
2. the covers (40*a*, 40*b*) are securely yet removably attached to each of the frames (20), thereby enabling easy cleaning and repair;
3. the mattress (10) can be easily stored and transported; and
4. each upper and lower cover (40*a*, 40*b*) can be of a color or pattern different to the others whereby a user can arrange the configurations thereof to provide many permutations of design.

It is to be understood, however, that even though numerous characteristics and advantages of the present invention have been set forth in the foregoing description, together with details of the structure and function of the invention, the disclosure is illustrative only and changes may be made in detail, especially in matters of shape, size and arrangement of parts within the principles of the invention to the full extent indicated by the broad general meaning of the terms in which the appended claims are expressed.

What is claimed is:

1. A sectioned ergonomic bed mattress formed of a plurality of sub-mattresses separably attached to each other, each sub-mattress comprising;

a frame;

a plurality of springs of different lengths received within the frame;

at least one buffer pad received within the frame and with an inner face contoured to mate with a stepped surface of the plurality of springs, and a flat outer face;

at least one cover portion with a pattern or a color different to the colors or patterns of the covers of the other sub-mattresses and extending over the at least one buffer pad, and secured by a peripheral portion thereof to the frame; and clamping means whereby the cover is secured to the frame and the sub-mattresses are secured to at least one other of the sub-mattresses, wherein the sectioned ergonomic bed mattress has a variable appearance via permutations of the different colors and patterns of the sub-mattresses.

2. The sectioned ergonomic bed mattress as claimed in claim 1, wherein the clamping means comprises a plurality of studs extending from each frame, a plurality of clamps each defining a plurality of through-holes through which the studs respectively extend, and a plurality of screw caps threadingly respectively engaged with the plurality of studs and urging against the clamps, whereby at least one of the clamps extends between two adjacent sub-mattresses.

3. The sectioned ergonomic bed mattress as claimed in claim 1, comprising two of the covers and formed as an upper cover and a lower cover.

4. The sectional ergonomic bed mattress as claimed in claim 1, comprising two of the buffer pads and formed as an upper buffer pad and a lower buffer pad.

* * * * *